US010669656B2

(12) United States Patent
Green et al.

(10) Patent No.: US 10,669,656 B2
(45) Date of Patent: Jun. 2, 2020

(54) UPPER FOR AN ARTICLE OF FOOTWEAR HAVING A KNITTED COMPONENT WITH A FUSED AREA

(71) Applicant: NIKE, Inc., Beaverton, OR (US)

(72) Inventors: Jessica Green, Hillsboro, OR (US); Chun-Ying Hsu, Tainan (TW); Jaroslav J. Lupinek, Portland, OR (US); Darryl Matthews, Portland, OR (US); William C. McFarland, II, Portland, OR (US); Chun-Yao Tu, Changhua County (TW); Yi-Ning Yang, Beaverton, OR (US); Cheng-Ying Han, Kaohsiung (TW)

(73) Assignee: NIKE, Inc., Beaverton, OR (US)

( * ) Notice: Subject to any disclaimer, the term of this patent is extended or adjusted under 35 U.S.C. 154(b) by 308 days.

(21) Appl. No.: 15/443,808

(22) Filed: Feb. 27, 2017

(65) Prior Publication Data

US 2017/0245582 A1 Aug. 31, 2017

Related U.S. Application Data

(60) Provisional application No. 62/301,436, filed on Feb. 29, 2016.

(51) Int. Cl.

| | |
|---|---|
| ***D04B 1/24*** | (2006.01) |
| ***D04B 1/16*** | (2006.01) |
| ***A43B 1/04*** | (2006.01) |

(52) U.S. Cl.

CPC ..... *D04B 1/24* (2013.01); *A43B 1/04* (2013.01); *D04B 1/16* (2013.01);

(Continued)

(58) Field of Classification Search

CPC ..... D04B 1/16; D04B 1/24; D04B 21/207; A43B 1/04

See application file for complete search history.

(56) References Cited

U.S. PATENT DOCUMENTS 5,778,702 A * 7/1998 Wrightenberry ..... A41B 11/005 2/239
6,158,253 A * 12/2000 Svoboda ..... A41B 11/004 2/239

(Continued)

FOREIGN PATENT DOCUMENTS

CN 103844428 6/2014
CN 104066350 9/2014

(Continued)

OTHER PUBLICATIONS

International Search Report and Written Opinion in corresponding International Application No. PCT/US2017/017768, dated Jun. 7, 2017, 17 pages.

(Continued)

*Primary Examiner* — Danny Worrell
(74) *Attorney, Agent, or Firm* — Brinks Gilson & Lione

(57) ABSTRACT

The present disclosure provides an upper for an article of footwear. The upper may include a knitted component having a first yarn and a second yarn, where the first yarn comprises a core with a sheath, the sheath being formed of a thermoplastic material having a melting temperature. The second yarn may be substantially free of the thermoplastic material. The knitted component may further comprise a first layer having a first surface and a second layer having a second surface, where the first layer and the second layer are secured via a knit structure of the knitted component, and where the knitted component further comprises a first region and a second region.

20 Claims, 7 Drawing Sheets

(52) U.S. Cl.
CPC ..... *D10B 2401/041* (2013.01); *D10B 2403/0114* (2013.01); *D10B 2403/023* (2013.01); *D10B 2403/032* (2013.01); *D10B 2501/043* (2013.01); *D10B 2501/061* (2013.01)

(56) References Cited

U.S. PATENT DOCUMENTS

| | | | | |
|---|---|---|---|---|
| 6,588,237 | B2 * | 7/2003 | Cole | A43B 23/0255 66/202 |
| 8,997,529 | B1 * | 4/2015 | Podhajny | D04B 1/16 66/177 |
| 8,997,530 | B1 * | 4/2015 | Podhajny | A43B 1/04 66/177 |
| 9,150,986 | B2 * | 10/2015 | Dua | D04B 1/16 |
| 2004/0118018 | A1 * | 6/2004 | Dua | A43B 1/04 36/45 |
| 2008/0110048 | A1 * | 5/2008 | Dua | A43B 1/04 36/45 |
| 2010/0154256 | A1 * | 6/2010 | Dua | A43B 1/04 36/25 R |
| 2010/0199406 | A1 | 8/2010 | Dua et al. | |
| 2012/0246973 | A1 | 10/2012 | Dua | |
| 2013/0260104 | A1 | 10/2013 | Dua et al. | |
| 2014/0059886 | A1 | 3/2014 | Lyttle et al. | |
| 2014/0150292 | A1 | 6/2014 | Podhajny et al. | |
| 2015/0075031 | A1 * | 3/2015 | Podhajny | A43B 1/04 36/45 |
| 2015/0107307 | A1 * | 4/2015 | Kosui | D04B 1/22 66/177 |

FOREIGN PATENT DOCUMENTS

| | | | |
|---|---|---|---|
| CN | 104363782 | A | 2/2015 |
| CN | 204697972 | U | 10/2015 |
| CN | 105077847 | A | 11/2015 |
| EP | 2 805 638 | A1 | 11/2014 |
| WO | WO 2015/011148 | A1 | 1/2015 |

OTHER PUBLICATIONS

Invitiation to Pay Additional Fees in corresponding International Application No. PCT/US2017/019668, dated Jun. 22, 2017, 15 pages.

International Search Report and Written Opinion in corresponding International Application No. PCT/US2017/019668, dated Aug. 17, 2017, 21 pages.

Office Action, and English language translation thereof, in corresponding Taiwan Application No. 106104988, dated Nov. 28, 2017, 33 pages.

Office Action for Chinese Patent Application 201780014111.X dated May 24, 2019, 9 pgs. including English translation.

* cited by examiner

UPPER FOR AN ARTICLE OF FOOTWEAR HAVING A KNITTED COMPONENT WITH A FUSED AREA

CROSS REFERENCE TO RELATED APPLICATIONS

This application claims priority to U.S. provisional patent application Ser. No. 62/301,436, filed Feb. 29, 2016, which is incorporated by reference herein in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

DESCRIPTION

In one aspect, the present disclosure provides an upper for an article of footwear. The upper may include a knitted component having a first yarn and a second yarn, where the first yarn has a core with a sheath, the sheath being formed of a thermoplastic material having a melting temperature, where the second yarn is substantially free of the thermoplastic material, where the knitted component further includes a first layer having a first surface and a second layer having a second surface, where the first layer and the second layer are secured via a knit structure of the knitted component, and where the knitted component further includes a first region and a second region.

The first region may include the first surface substantially formed by the first yarn and the second surface substantially formed by the second yarn. The first yarn of the first surface may be incorporated into the second surface at least at one location within the first region. The first region may extend along an edge adjacent to a biteline of the upper.

A second region may include the first surface substantially formed by the second yarn and the second surface substantially formed by the first yarn. The second region may extend along a throat area of the upper.

The first yarn may be thermoformed to form a fused area.

The thermoplastic polymer material of the sheath may consist essentially of at least one thermoplastic polyurethane. The core of the first yarn may include at least one polyester.

The first layer may be integrally knit with the second layer.

The upper may include a throat area formed by the thermoplastic polymer material extending from an edge of the upper towards the throat area, where the fused area terminates adjacent to the throat area.

An auxiliary component may be formed by a material other than a knitted material and secured to the fused area via the thermoplastic polymer material.

In another aspect, the present disclosure provides an upper that may include a knitted component having a first yarn and a second yarn, where the first yarn has a core with a sheath, the sheath being formed of a thermoplastic material having a melting temperature, where the second yarn is substantially free of the thermoplastic material, where the knitted component further includes a first layer having a first surface and a second layer having a second surface, where the first layer and the second layer are secured via a knit structure of the knitted component, and where a fused area is formed by the thermoplastic polymer material on the first layer in a first region.

The upper may further include a second region, where the second yarn forms at least a portion of the first layer in the second region. The first yarn may form at least a portion of the second layer in the second region.

The fused area may extend along an edge adjacent to a biteline of the upper.

The fused area may terminate adjacent a throat area of the upper.

In another aspect, the present disclosure provides a method of manufacturing an upper for an article of footwear. The method may include knitting a knitted component having a first layer and a second layer, where the first layer includes a first yarn having a core and a sheath, the sheath formed of a thermoplastic polymer material with a melting point, where the second layer includes a second yarn being substantially free of the thermoplastic polymer material, heating at least a portion of the thermoplastic polymer material of the first yarn to form a fused area on the first layer, and cooling the knitted component to set the fused area.

The method may further include placing an auxiliary structure in contact with the knitted component and providing an amount of energy to at least one of the auxiliary structure and the knitted component to adhere the auxiliary structure to the knitted component.

The first layer may be at least partially formed on a first bed of a flat knitting machine and the second layer may be at least partially formed on a second bed of the knitting machine.

DETAILED DESCRIPTION

Figure 1:
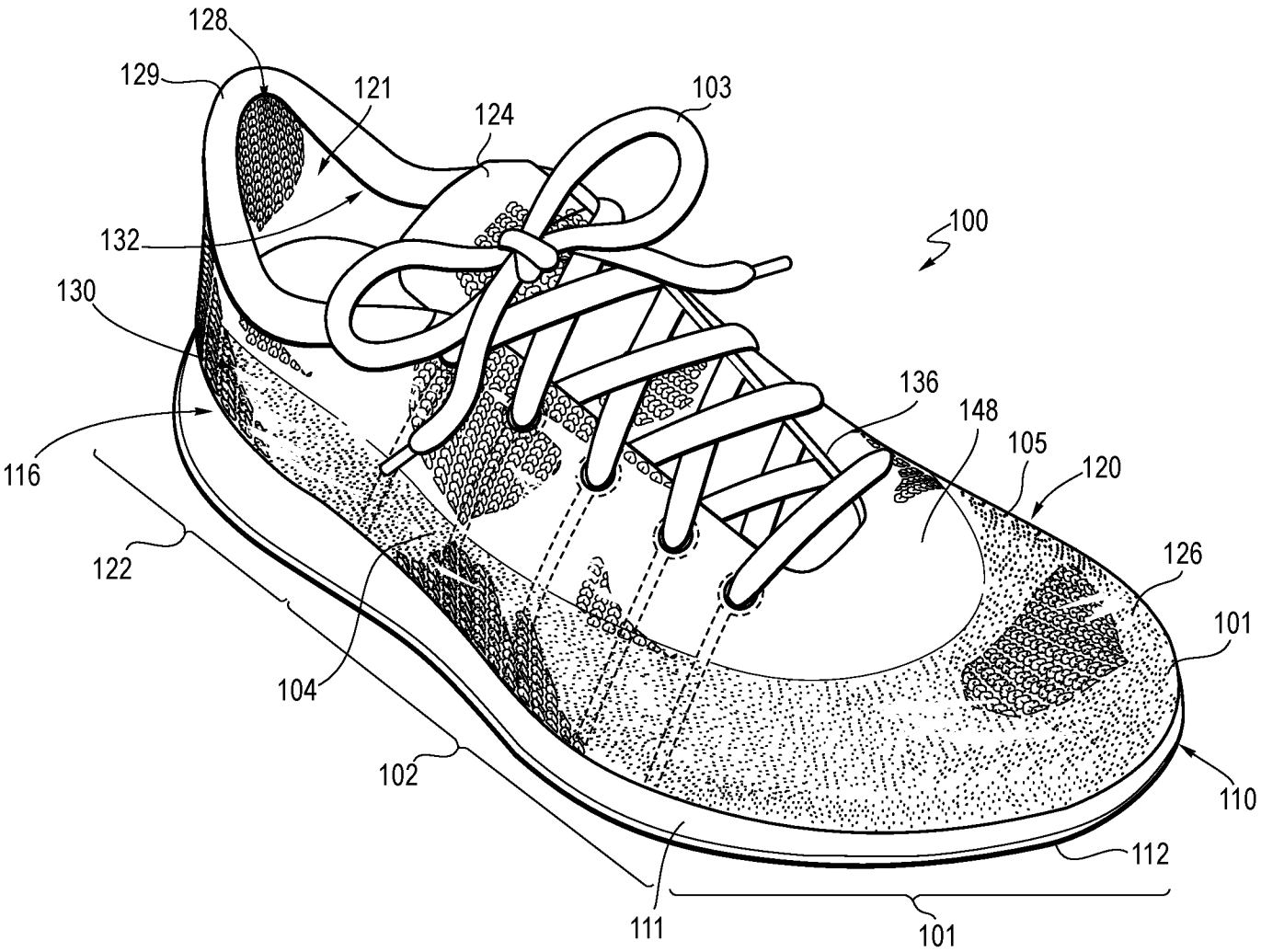
FIG. 1 shows an example of an article of footwear in accordance with certain aspects of this disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to uppers configured for use in an article of footwear. The uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic footwear and shoes, such as dress shoes, loafers, and sandals.

With respect to FIG. 1, an example of an article of footwear 100 is generally depicted as including a sole 110 and an upper 120. The upper 120 may include a lateral side 104, a medial side 105, a heel region 122, a mid-foot region 102, and a toe region 101. The area of the shoe where the sole 110 joins the outer edge of the upper 120 may be referred to as the biteline 116. The upper 120 may be joined to the sole 110 in a fixed manner using any suitable technique, such as through the use of an adhesive, bonding, sewing, etc.

In some embodiments, the sole 110 may include a midsole 111 and an outsole 112. The article of footwear may additionally include a throat 136 and an ankle opening 121, which may be surrounded by a collar 129. The upper 120 may define a void 128 of the article of footwear that is configured to receive and accommodate the foot of a user or wearer. The throat 136 may generally be disposed in the mid-foot region 102 of the upper 120. The mid-foot region 102 is depicted as a section of the upper 120 located between the heel region 122 and a toe region 101.

In FIG. 1, a tongue 124 is disposed in the throat 136 of the shoe, but the tongue 124 is an optional component, as is the lace 103. Although the tongue 124 depicted in FIG. 1 is a traditional tongue, the tongue 124, if included, may be any type of tongue, such as a gusseted tongue or a burrito tongue. If a tongue is not included, the lateral and medial sides of the throat 136 may be joined together, for example.

The throat area 148 may include one or more loops 152 extending from the depicted tensile strands 154. The tensile strands 154 are an optional component, and may form lace apertures (e.g., the aperture through the loops 152) to receive a lace and/or may surround lace apertures formed in the layers of the knit element 140. A tensile strand may be a yarn, a cable, a rope, or any other type of strand. A tensile strand may be flexible, but it also may have a substantially fixed length measured from a first end to a second end. As such, the tensile strand can be substantially inelastic. The one or more tensile strands may extend across the upper 120 in any direction. The tensile strands can be at least partially inlaid within the knit element 140. The tensile strands may limit the stretch of the knit element. Also, in some aspects, portions of the tensile strands may be exposed from knit element. For example, portions of the tensile strands may extend out of the knit element in the throat region to form loops 152. See, for example, U.S. Patent Application Publication No. 2015/0359290, U.S. Patent Application Publication No. 2014/0237861, and U.S. Pat. No. 9,145,629, which are incorporated into the present application in their entirety. The tensile strands 154 may be placed between the layers of the knit element 140, and/or may be incorporated primarily into any one of the layers at any location of the knit element 140. The tensile strands 154 may be fixed within the fused area 126 in some embodiments, though this is not necessary.

As described in further detail below, the upper 120 may have a fused area 126 at least partially formed of a thermoplastic polymer material. In this description, the term "fused area" generally means an area of the upper 120 where distinct portions of material forming the upper (e.g., distinct individual strands or yarns of a knitted component) are partially or substantially bonded together. A "fused area" is not required to be formed by any specific process. In a non-limiting example, two or more separate yarns, including monofilament and/or multifilament yarn, may form a fused area when at least a portion of the separate yarns are bonded such that at least a portion of the separate yarns become continuous with one another. Further, after bonding to form a fused area, the material of the once-separate yarns may become visually or physically indistinguishable, or both.

The fused area 126 may have any suitable size and shape, and the upper 120 may have multiple fused areas 126. The fused area(s) 126 may define a portion of a first surface 130 of the upper 120, which may be an outer surface. As depicted, a second surface 132 of the upper 120 may be an inner surface at least partially defining the void 128 of the article of footwear, and the second surface 132 may be located at least partially between the fused area 126 and the void 128 of the article of footwear (such that the fused area 126 is separated from the void at least at one location, for example). The fused area 126 may extend from the biteline 116 towards the throat 136 and/or the collar 129. In some embodiments, the fused area 126 may extend along substantially the entirety of the biteline 116 (e.g., substantially around the entire perimeter of the article of footwear). As described in more detail below, the fused area 126 may be water repellant, water resistant, and/or substantially waterproof.

Figure 2:
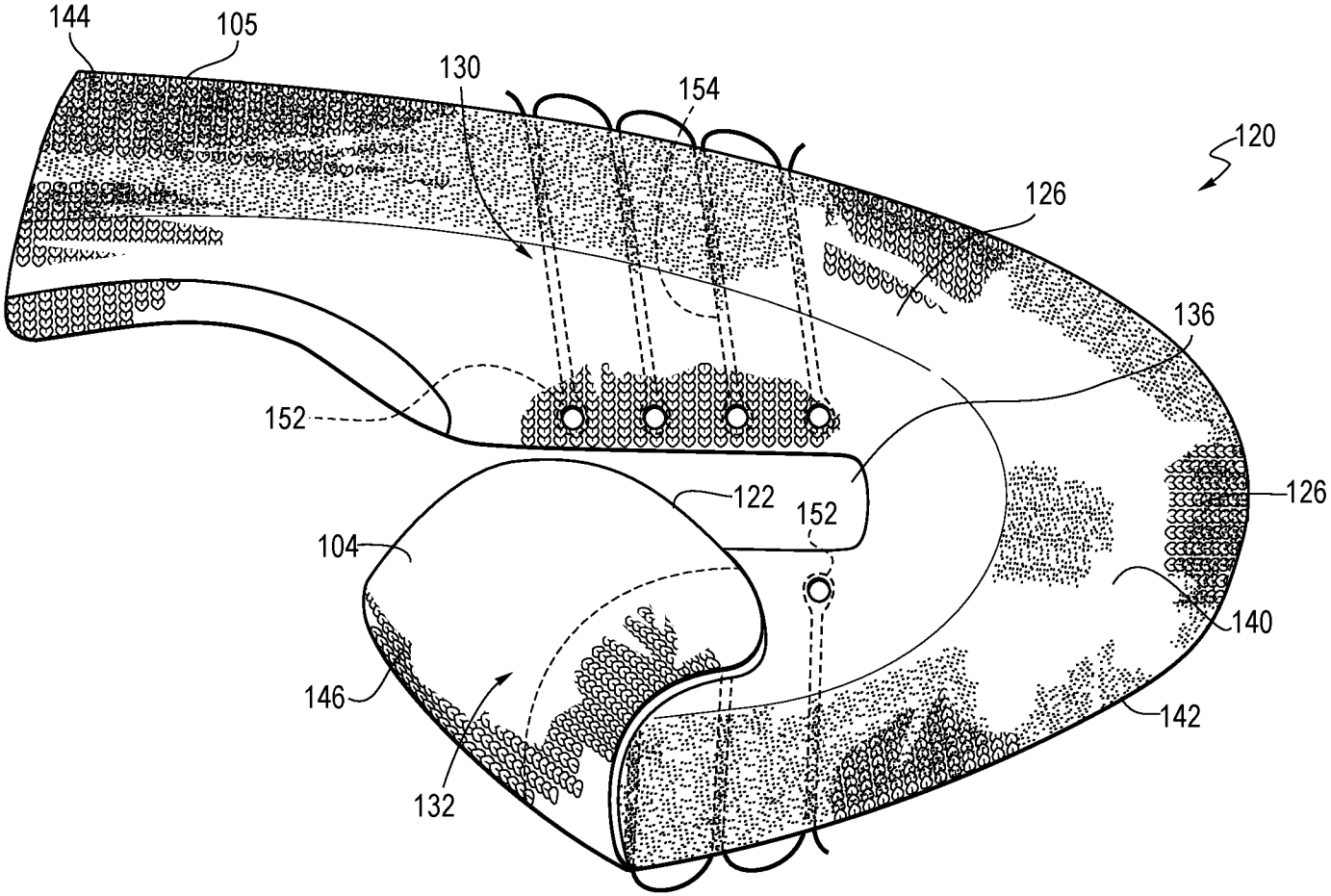
FIG. 2 shows an upper including a knitted component and a fused area in accordance with certain aspects of this disclosure.

Referring to FIG. 2, the upper 120 (shown separate from other elements of the article of footwear of FIG. 1) may be formed at least partially of a knitted component 140 (and at least a portion of the knitted component may be referred to as a "knit element"). As depicted in FIG. 2, the upper 120 may be substantially or entirely formed of the knitted component 140. While the upper 120 is described herein as including the knitted component 140, it alternatively or additionally could include a textile component formed by a process other than knitting (e.g., weaving) and may also include other materials including but not limited to leather, plastics, rubbers, and any other materials suitable for incorporation into the upper of an article of footwear. The knitted component 140 may be a single layer knitted component or it may be a multi-layer knitted component. In some embodiments, the knitted component 140 may be a two-layer knitted component with a first layer forming the first surface 130 (e.g., outer surface) and a second layer forming the second surface 132 (e.g., inner surface) as described in further detail below. While not required in all embodiments, the first and second layers may both be knitted layers, and they will be referred to herein as the "first layer" and the "second layer."

The first surface 130, which may be formed of the first layer, may include at least one fused area 126, and the fused area 126 may extend partially or continuously along a perimeter edge 142 from the heel region 122 on the lateral side 104, around the toe region 101, and back to the heel region 122 on the medial side 105. The heel region 122 may be a region in the area near the tarsus of a foot of the wearer and does not necessarily have to extend behind the heel of the wearer. The fused area 126 may extend continuously along substantially the entirety of the perimeter edge 142 such that when the upper 120 is incorporated into an article of footwear, the fused area 126 provides the article of footwear with water repellence, water resistant, and/or substantially waterproof characteristics above (and also possibly below) the biteline 116. The fused area 126 may extend any distance from the perimeter edge 142 towards the throat 136 and/or the collar 129. In one exemplary embodiment, the fused area 126 extends a distance from the edge 142 such that the fused area 126 covers at least approximately 10 millimeters above the biteline 116 (see FIG. 1) of an article of footwear. In other embodiments, the fused area 126 may provide more or less coverage, and it is contemplated that the fused area 126 may cover at least approximately 50 millimeters, 1 centimeter, 5 centimeters, or even more above the biteline 116. It is further contemplated that the fused area 126 may terminate slightly inward from the terminus of the perimeter edge 142 of the upper 120, which may be advantageous when non-fused portions of the upper 120 are more suitable for attachment to other elements of the article of footwear (e.g., a midsole). In other words, there may be a border of a non-fused area around at least a portion of the perimeter edge 142.

As shown in exemplary FIG. 2, a first yarn 144 may form at least a portion of the first (outer) surface 130 of the knitted component 140. In this description, the first yarn 144 may include a yarn (or multiple yarns) that includes or incorporates a thermoplastic polymer material configured to form the fused area 126. Illustrative, non-limiting examples of thermoplastic polymers include polyurethanes, polyamides, polyolefins, and nylons. In contrast to thermoset polymeric materials (described below), thermoplastic polymers melt when heated and return to a solid state when cooled. More particularly, a thermoplastic polymer transitions from a solid state to a softened or liquid state when subjected to temperatures at or above its melting point, and then the thermoplastic polymer transitions from the softened or liquid state to a solid state when sufficiently cooled below its melting point.

Any portion of the first yarn 144 may have one or more thermoplastic polymers (collectively "the thermoplastic polymer material"), and in some embodiments, substantially the entirety of the first yarn 144 may be formed of the thermoplastic polymer material. In one non-limiting example, the first yarn 144 may be a yarn with a polyester core and a thermoplastic polymer sheath. The thermoplastic polymer material of the sheath may have a melting temperature less than the melting temperature or decomposition temperature of the polyester core. For example, the melting temperature of the thermoplastic polymer material may have a melting temperature of approximately 100° C. less than the melting temperature of the polyester core in some embodiments, though any other suitable difference in melting temperatures is contemplated. The melting temperature of the polyester core may be about 260° C., and the decomposition temperature may be about 350° C. or greater. The melting temperature of the thermoplastic polymer may be, for example, between about 80° C. and about 1° C., such as from about 100° C. to about 125° C. based on atmospheric pressure at sea level. In an exemplary embodiment, the first yarn 144 may include a sheath formed of a thermoplastic polyurethane. The first yarn 144 may specifically be a yarn marketed as a Dream-Sil® thermoplastic polyurethane coated yarn manufactured by Sambu Fine Chemical Co., LTD.

The knitted component 140 may also include one or more yarns formed of material(s) other than the specific thermoplastic polymer material described above. In one example, the depicted second yarn 146 may be substantially formed of a material that has a melting point (if it is a thermoplastic polymer material) or a decomposition point (if it is a thermoset material) that is higher than the melting point of the first yarn 144. Illustrative, non-limiting examples of types of yarns that may form the second yarn 146 include yarns comprising thermoset polymeric materials and natural fibers, such as cotton, silk, and wool, or materials with a relatively high melting point. When subjected to moderate levels of heat, thermoset polymeric materials tend to remain stable. Moreover, when subjected to elevated levels of heat, thermoset polymeric materials and natural fibers may burn or otherwise degrade or decompose. As such, thermoset polymeric materials generally remain in a permanent solid state. In some embodiments, the melting point or decomposition temperature of the second yarn 146 is greater than about 140° C. based on atmospheric pressure at sea level. The second yarn 146 may also be formed of a material with a melting point higher than that of the first yarn 144, and references to the first yarn as being formed of a thermoplastic polymer material herein do not limit the second yarn from being a separate thermoplastic polymer with a higher melting point, for example. One specific example is a polyester yarn, which may have a melting point of about 250° C., and a boiling or decomposition point of about 350° C. It is noted that the second yarn 146 may comprise one or multiple yarns with one or multiple properties including yarn(s) with different elasticity, breathability and/or durability characteristics or different visual characteristics, or a combination thereof, for example.

As described above, the knitted component 140 may have more than one layer. In one embodiment, at least a portion of the knitted component 140 has two layers: a first layer defining the first surface 130 and a second layer defining the second surface 132. While more than two layers could be included, this description generally describes the knitted component 140 as having two layers for simplicity of description. Further, it is contemplated that different portions of the knitted component 140 could have a different number of layers (e.g., a portion corresponding to the fused area 126 may have multiple layers, while a portion corresponding to areas without the fused area 126 may have only one layer).

The first and second layers of the knitted component 140 may be separately formed or integrally formed, and one or both layers may be formed during a knitting or other textile manufacturing process. In one example, the first layer defining the first (outer) surface 130 and the second layer forming the second (inner) surface 132 may be formed during a single knitting process (e.g., simultaneously on a knitting machine). For example, the first and second layers may be formed on a flat knitting machine with two needle beds. The first layer may be primarily formed on a front needle bed, and the second layer may be primarily formed on a back needle bed, or vice versa. In some embodiments, the first layer and the second layer may be integral and tightly bound together such that they are inseparable and/or are not readily distinguishable. In another example (or in another location of the knitted component 140), the knitted component 140 may have at least one location where the first layer and the second layer are separable and/or form a pocket therebetween, which may be filled with a filler material (e.g., a cushioning material). It is contemplated that the first layer and the second layer may be attached only at the edges of the knitted component 140 or the first and second layers may be attached at additional points by a tie stitch at any one or more points on the upper. Further, it is contemplated that the knitted component 140 may have some areas where the layers are substantially bound or attached together (in an indistinguishable manner, or not) and other areas where they are substantially separable. Separable first and second layers may be formed by a tubular knitting process where the yarns forming the first layer are knitted only on one bed of a knitting machine and the yarns of the second layer are knitted only on a second bed of the knitting machine. Alternatively, the knitted component 140 may be formed of two or more layers that are knitted or otherwise formed separately and then joined together by, for example, a sewing or stitching process, by using an adhesive, or by another suitable bonding/attachment technique.

The first layer defining the first surface 130 of the knitted component 140 may include the first yarn 144 such that the first layer includes a thermoplastic polymer material, at least at locations of the first layer configured for forming the above-described fused area 126. It is also contemplated that the thermoplastic polymer material may additionally or alternatively be added to the first layer separate from a yarn (e.g., it could be sprayed on or otherwise applied after the knitting process). In some embodiments, the first layer of the knitted component 140 may be formed substantially of the first yarn 144, at least in areas corresponding to the fused area 126. However, other yarns (like the second yarn 146) may additionally or alternatively be incorporated into the first layer at certain locations. The amount of the first yarn 144 incorporated into the first layer, and/or the quantity of the thermoplastic polymer material included in the first yarn 144, may be optimized such that a desirable amount of the thermoplastic polymer material is included at specific and desired areas, including areas corresponding to the fused area 126. For example, if the area of the first layer includes both the first yarn 144 and the second yarn 146 (or some other combination such that both a thermoplastic polymer material and a different material are included), the ratio of the thermoplastic polymer material to non-thermoplastic polymer materials in that area may be from about 5:95, about 10:90, about 20:80, about 30:70, about 40:60, about 50:50, about 60:40, about 70:30, about 80:20, about 90:10, about 95:10, and about 100:0. The first layer may also include areas that substantially exclude the first yarn 144 (e.g., in the throat area 148, as depicted in FIG. 1).

As shown in FIG. 2, at areas corresponding to the fused area 126, the second layer forming the second surface 132 of the knitted component 140 maybe formed substantially of the second yarn 146, which may be substantially free of thermoplastic polymer materials or may be formed of thermoplastic polymer material(s) with a relatively high melting point. In exemplary embodiments, the second yarn 146 is a polyester yarn. Several different types of yarns with varying properties (e.g., varying stretch, durability and/or breathability properties, deniers, and/or colors or a combination thereof) may be included. There are several advantages that are associated with a second layer being formed of the second yarn 146. In one non-limiting example, the second surface 132, which may be configured to face the void 128 of the article of footwear, may be formed of a yarn including a material that achieves a comfortable inner surface for contacting a foot of a wearer. The second layer may further be formed to have a high degree of elasticity such that selected portions of the article of footwear are relatively elastic, particularly at areas not corresponding with the fused area 126.

When the first layer and the second layer are formed together on a knitting machine, it is contemplated that the two layers have an inverse composition of the thermoplastic polymer material configured to form the fused area and a second material. For example, in the fused area 126 (where thermoplastic polymer material is desired on the outer surface 130), approximately 90% or more of the thermoplastic polymer material at that location may be within the first layer forming the outer surface 130, and approximately 10% or less of the thermoplastic polymer material in the second layer forming the inner surface 132. In another area, such as in the throat area 148, most of the thermoplastic polymer material may instead be located in the second layer forming the inner surface 132. Advantageously, the thermoplastic polymer material may form the fused area 126 at certain locations during heat processing (as described in more detail below), but the thermoplastic polymer material may be shielded from heat applied to the outer surface 130 other areas (such as the throat area 148) thereby preventing fusing where it may not be desirable.

The second layer of the knitted component 140 may be located at least partially between the first layer with a fused area 126 and the void 128 (shown in FIG. 1). This may provide a knitted component 140 of an upper 120 that has the above-described fused areas 126 on one side (e.g., the first surface 130), but does not have fused areas on the opposite side (e.g., second surface 132). Advantageously, this knitted component 140 may provide an article of footwear with both the desired features of the above-described fused area 126 (e.g., water repellence, water resistance, and water-proofing) while simultaneously providing advantages associated with the second yarn 146 including but not limited to comfort and elasticity. Further, all of the described advantages related to the second layer also may apply to the first layer in areas where the fused area 126 is not present. It is also contemplated that thermoplastic polymer materials may exhibit advantageous characteristics associated with the second yarn 146 when not heat-processed.

When the second layer forms the inner surface 132, the second layer of the knitted component 140 does not need to be completely free of thermoplastic polymer material even in the fused area 126. In some embodiments, the first yarn 144 may be integrated into the second layer of the knitted component 140. For example, during a knitting process where the first layer and the second layer are substantially formed on different needle beds of a knitting machine, the first yarn 144 may be knitted on needles of the bed associated with the second layer at selected locations. This may physically attach and/or bind the first layer and the second layer together at one or more points. Additionally or alternatively, by tucking the first yarn 144 during the knitting process at a series of locations, a series of floats of the first yarn 144 may be formed that extend behind (e.g., inward of) the first layer. Advantageously, these described floats may enhance some of the desirable characteristics of the fused area 126 (e.g., water resistance). For example, the floats may reduce and/or eliminate pores within the fused area 126 by, for example, extending behind and filling certain areas that may otherwise be porous. It is also contemplated that a fused area may be desirable on the second layer in some instances.

Similarly, the second yarn 146 that is generally associated with the second layer of the knitted component 140 may be knitted on or otherwise moved to the bed associated with the first layer of the knitted component 140 at selected locations. This may be advantageous, for example, in areas where the second yarn 146 has properties that may provide the first layer of the knitted component 140 with particular characteristics (e.g., elasticity, desirable aesthetics, durability, breathability and/or a combination thereof), and/or where the second yarn 146 is used to bind the first and second layers of the knitted component 140 together at one or more select points throughout the upper 120.

Figure 3:
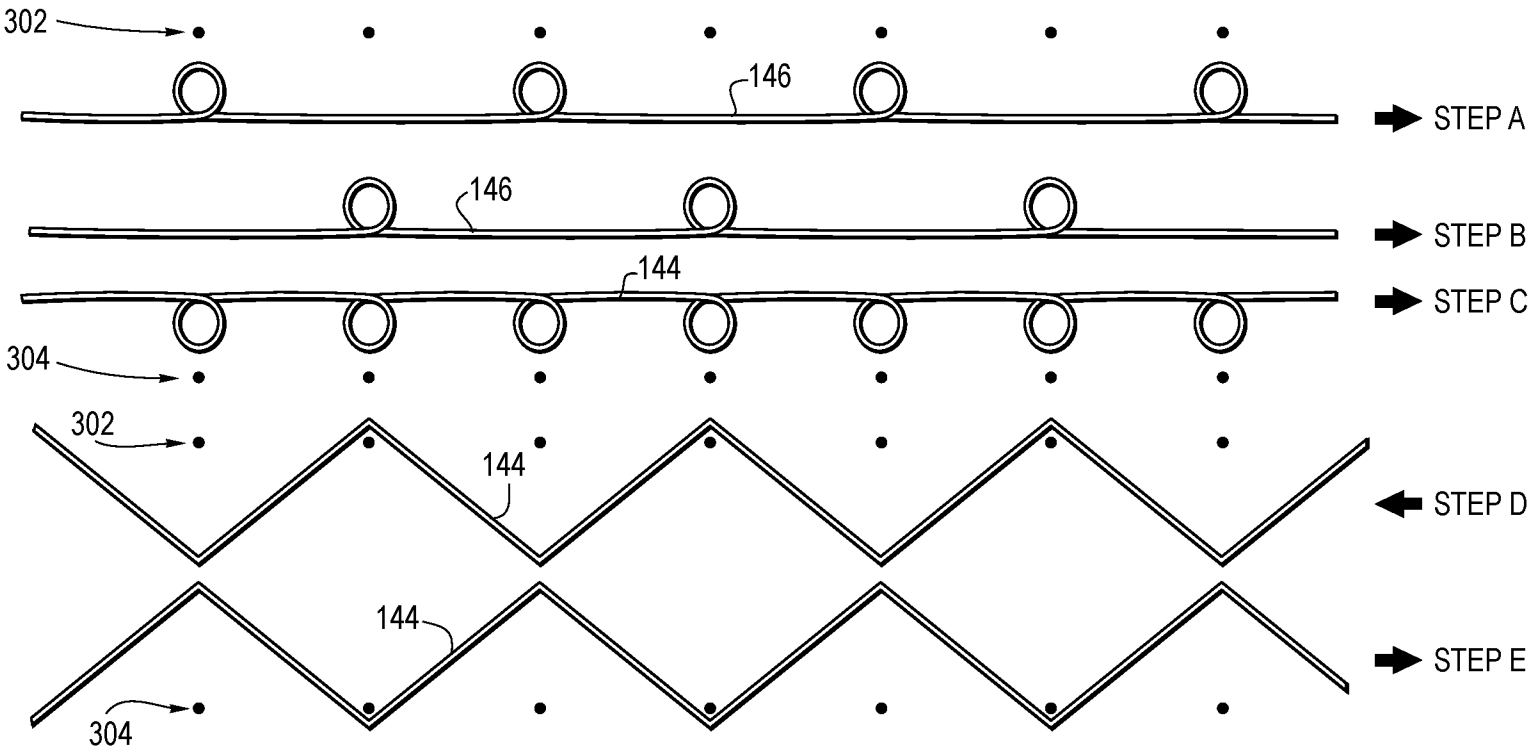
FIG. 3 shows an example of a knit diagram of one sequence for knitting a knitted component in accordance with certain aspects of this disclosure.

When forming the first and second layers of the knitted component 140 on a knitting machine, any suitable knitting sequence may be used. One knitting sequence that has been found to be suitable is shown in FIG. 3. Referring to FIG. 3, the first pass in a series of knitting passes may include knitting the second yarn 146 on every other needle of the back bed 302 as shown in step A. Next, in a second pass as shown in step B, another second yarn 146 (which may be the same or may be a separate yarn than the one used in the first pass) may be knitted on the back bed 302 on the needles not used in step A. Providing two passes of the second yarn 146 rather than a single pass on the back bed may provide several advantages, such as a tight, non-porous structure, the ability to vary color configurations on the second surface 132 (FIG. 2), the ability to control the elasticity of the knitted component 140, and/or the ability to control the softness and other surface characteristics of the second surface 132. The next depicted step, step C, may include knitting the first yarn 144 (e.g., the yarn comprising the thermoplastic polymer material) on all of the needles of the front bed 304 of the knitting machine. Each pass depicted in steps A-C may be performed in a first direction 306 along the needle bed. In step D, now moving in the second direction 308, the first yarn 144 may be transferred to the back bed 302 on every other needle. Finally, in step E, again moving in the first direction 306, the first yarn 144 may be transferred to the back bed on every other needle (on opposite needles with respect to step D). This knitting sequence may then be reversed and repeated as necessary. Again, the knitting sequence described in FIG. 3 is provided only as a non-limiting example, and any other suitable sequence may be used.

Figure 4:
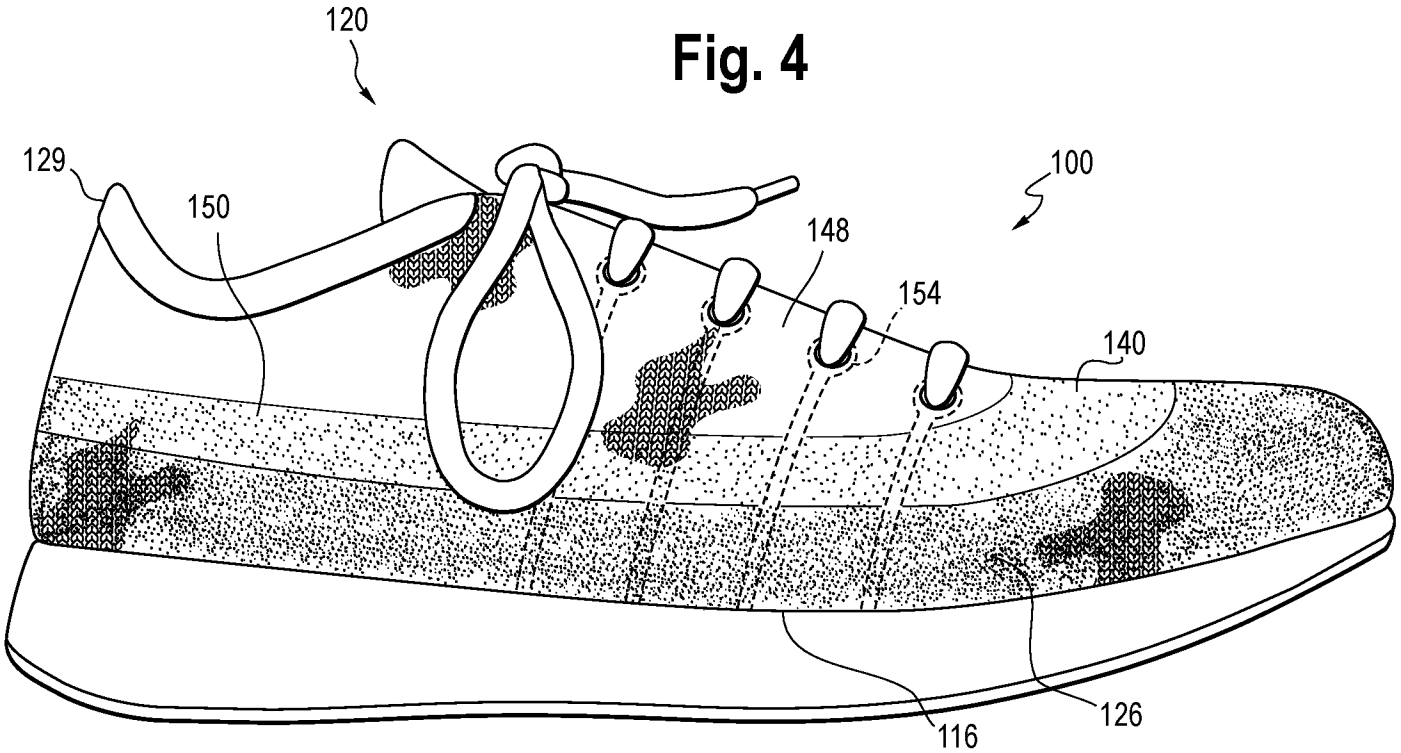
FIG. 4 shows an example of an article of footwear including an upper with a knitted component having a fused area and a transitional zone in accordance with certain aspects of this disclosure.

Referring to FIG. 4, the upper 120 is shown as having a fused area 126 that may extend from the biteline 116 (and/or the edge 142 of FIG. 2) on the outer perimeter of the knitted component 140 towards the throat area 148. The fused area 126 may terminate near or adjacent to the throat area 148, and the throat area 148 may be substantially free of thermoplastic polymer material at least on an outer layer. The first layer at the throat area 148 may be substantially formed of the second yarn 146, which as described above may be a polyester yarn. This may advantageously provide the throat area 148 with desirable elasticity, which may allow the knitted component 140 of the upper 120 to stretch in the throat area 148 to thereby facilitate the entry and removal of a foot of a user within the void 128 of the article of footwear and provide a snug fit around the foot. The visual contrast between the throat area 148 and the fused area 126 may also be aesthetically advantageous. In other embodiments, the fused area 126 may extend to and/or within the throat area 148.

In some embodiments, the amount and/or the density of the fused and/or non-fused thermoplastic polymer material present in one or more of the layers of the knitted component 140 may vary. Hereinafter, the term "density" when referring to a fused area refers to the amount (i.e., mass) of fused material (e.g., fused thermoplastic polymer material) per a determined surface area. For example, in the embodiment depicted in FIG. 4, the amount and/or density of thermoplastic polymer material included in the outer (first) layer of the knitted component 140 may decrease when moving from the biteline 116 towards a throat area 148 of the article of footwear 100.

To illustrate, the first layer of the knitted component 140 may at least partially, and more preferably as shown in FIG. 4, fully or substantially be formed of a thermoplastic polymer material in an area adjacent to the biteline 116, which may be referred to as a first region. In a second region of the knitted component 140, depicted in FIG. 4 as the transition area 150 located between the fused area 126 and the throat area 148, the first layer may include a relatively reduced amount of the thermoplastic polymer material (which may be the result of some yarns formed of the thermoplastic polymer material being moved to the second or inner layer in that area). The transition area 150 may still include characteristics of the fused area 126 (e.g., water repellence, water resistance, water-proofing), but the degree of some of those characteristics may be relatively reduced when moving toward the throat area 148 and/or towards the collar 129. A third region, such as the throat area 148 and/or an area adjacent to the collar 129 of the knitted component 140, may have relatively less of the thermoplastic polymer material in the first layer than the transition area 150 and may even substantially exclude thermoplastic polymer material. In one non-limiting example, the ratio of the thermoplastic polymer material to another material in the first layer may be about 70:30 in the depicted fused area 126 adjacent to the biteline 116, about 50:50 in a location of the transition area 150, and about 5:95 or 0:100 in the throat area 148. It is further contemplated that fused areas (such as the transition area 150) may gradually decrease in their density of thermoplastic polymer material and/or ratio of fused and unfused thermoplastic polymer material to another material moving from one location to another (such as from the biteline 116 towards the throat area 148, for example).

It is also contemplated that instead of (or in addition to) varying the amount of the thermoplastic polymer at different areas of the knitted component 140, different areas of the knitted component 140 having the thermoplastic polymer may be processed differently (e.g., more heat and/or pressure may be administered in one or more areas near the biteline 116 than near the throat 136 during a heat-pressing process). In some embodiments, some selected areas of the knitted component 140 having the thermoplastic polymer may not form a fused area at all. For example, while the knitted component 140 may comprise the first yarn 144 in an outer layer of certain areas where a fused area is not desired, there may be no additional processing (e.g. heat processing or the like) that would result in the formation of a fused area in those areas.

The fused area 126 may be water resistant or substantially waterproof. In one testing process performed by the inventors for evaluating one embodiment of an article of footwear with a fused area 126 in accordance with this description, the article of footwear was placed in a container of water filled to a level up to 10 millimeters above the biteline 116 of the article of footwear. The fused area 126 extended to above the water level. The article of footwear stayed in the container for two hours. After the two hour time period expired, the article of footwear was removed from the container. No water was detected to have passed through the fused area 126.

Referring to FIG. 5A-D, in one non-limiting example, a thermoforming process such as a heat-pressing process may be performed to form the fused area 126 from a thermoplastic polymer material. More particularly, a thermoplastic polymer material may be incorporated into the knitted component 140 by knitting with above-described first yarn 144 having the thermoplastic polymer material.

FIGS. 5A-5D generally depict a heat press 560 and associated components. The heat press 560 may include a top plate 562 and a bottom plate 564. Each of these plates has a surface that may or may not provide heat and may or may not contact a side of the upper 520. The materials used to form the plates are not limited. In some aspects, the plates may include a metal and/or silicone or combination thereof. In some embodiments, the bottom plate 564 may be formed of silicone and the top plate 562 may be formed of a metal.

In some embodiments, an upper 520 may be disposed on the bottom plate 564, and the top plate 562 may be lowered until a surface thereof contacts the upper 520. An amount of pressure may be applied by the top plate and since the bottom plate is stationary, the upper 520 is at least partially compressed in one or more selected areas. In some aspects, after the top plate is lowered to contact the upper 520, the top plate and the bottom plate remain separated and do not contact each other. The heat press may comprise a stopper (not shown) to prevent the top plate 562 and bottom plate 564 from making contact with each other.

Figure 5B:
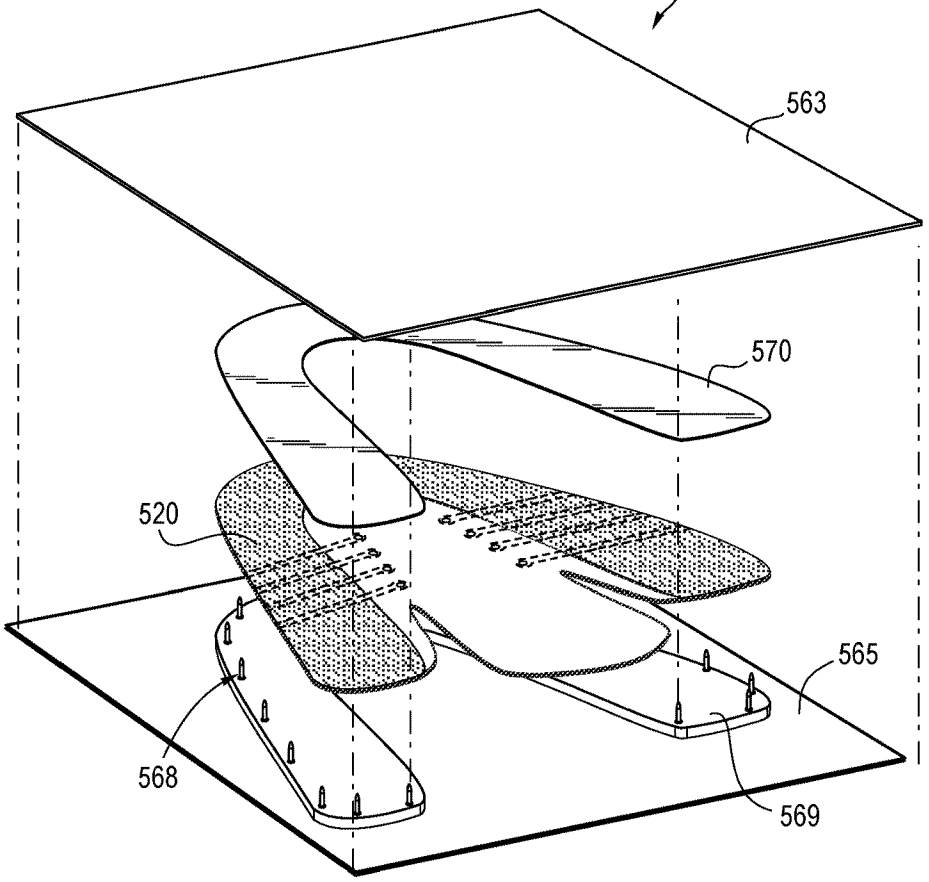
FIGS. 5A-D show an example of a heat press and related components used in one process of forming an upper with a fused area in accordance with certain aspects of this disclosure.
Figure 5A:
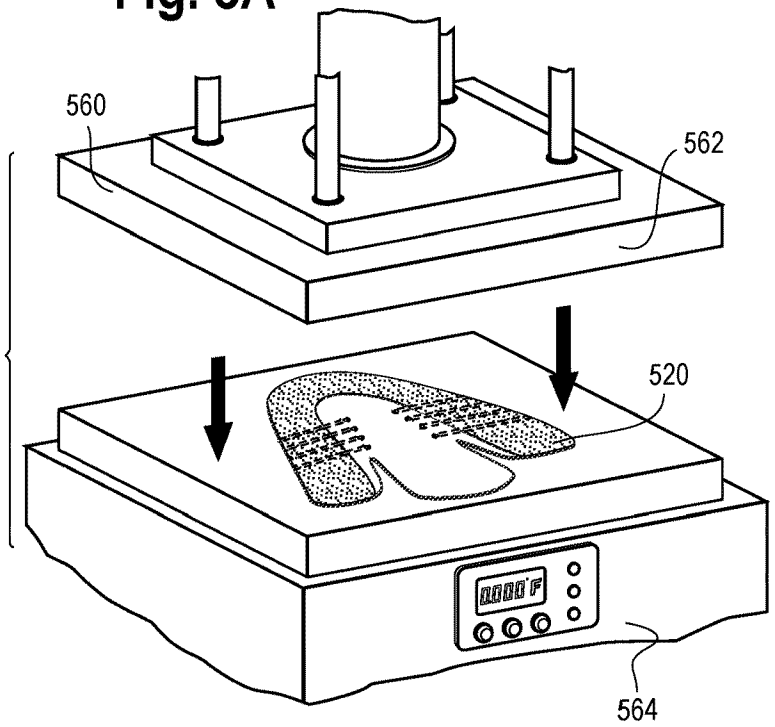

As shown in FIG. 5B, a jig 566 may be used to hold and/or position the upper 520 during the heat pressing process. The jig 566 may be a separate element from the heat press 560 or the jig 566 may be disposed on the bottom plate 564 of the heat press 560. The jig 566 may have a top section 563 and a bottom section 565, which may be formed using any material, such as rubber or metal. If the material used to form the jig 566 has a melting temperature, the melting temperature should be above the typical temperature achieved during the heat-pressing process to ensure that the heat-pressing process does not disfigure, alter, damage or otherwise negatively affect the jig 566. The shape and configuration of the jig 566 is also not limited. In FIG. 5B, the shape of the jig 566 is generally rectangular. The jig 566 may include a positioning device, in this case a plurality of spring-loaded pins 568 that is configured to position the upper 520. Here, the shape of the plurality of spring-loaded pins 568 is substantially the same as the shape of an upper 520 such that it corresponds with the outer perimeter of the upper 520. The upper 520 may include a plurality of apertures configured to receive the spring-loaded pins 568, and/or the spring-loaded pins may penetrate through the upper 520 to hold the upper 520 in position upon and within the jig 566.

The jig 566 may further include a pad 569 configured to prevent the upper 520 from sticking to the heat press 560. The pad may be insulative and/or provide cooling, particularly when the desired fused area (e.g., fused area 126 of FIG. 1) is located only on one side or one surface of the upper 520. The pad 569 may generally be in the shape of the desired fused area of the upper 520. The thickness of the pad 569 may reduce the amount of heat applied and even reduce or substantially prevent the areas of the upper 520 not corresponding to a fused area (e.g., the throat area) from being pressed, directly heated and/or burned. In one embodiment, the pad 569 is formed of Teflon and is approximately 5 mm thick, though any suitable thickness may be used. The spring-loaded pins 568 are configured to compress if necessary during the heat-pressing process such that they do not inhibit the pressure applied to the upper 520 (e.g., if the spring-loaded pins 568 are longer than the thickness of the upper 520). In some embodiments, the jig 566 may be configured such that two or more uppers 520 can be processed simultaneously. A release paper 570 may be placed over the areas corresponding to the fused area of the upper 520, as shown. The release paper is preferably constructed of a material that reduces or prevents the fused area of the upper from sticking to it and therefore, the release paper 570 may also prevent the fused area of the upper 520 from sticking to the jig 566. The release paper 570 may be configured to allow heat to be conducted to the upper 520 directly through the release paper 570 and without interfering in the heating process.

Figure 5D:
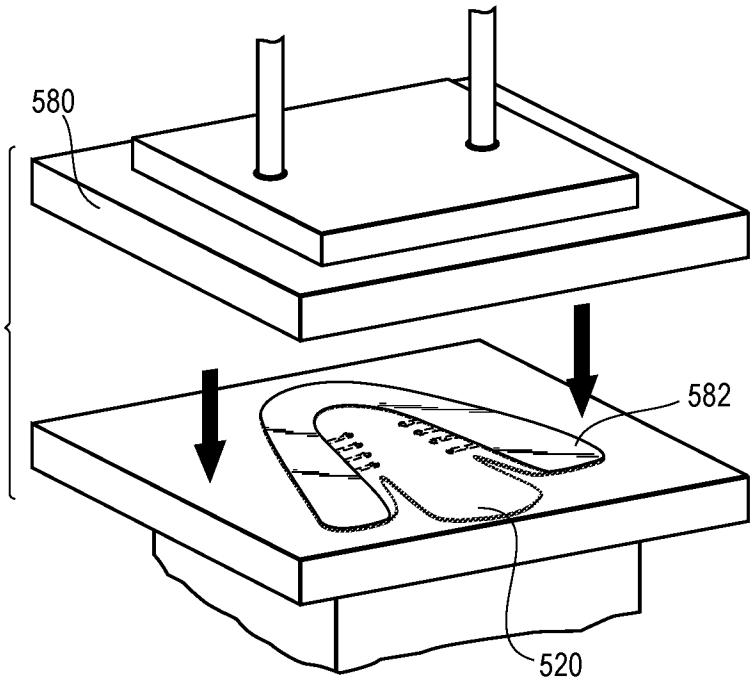
Figure 5C:
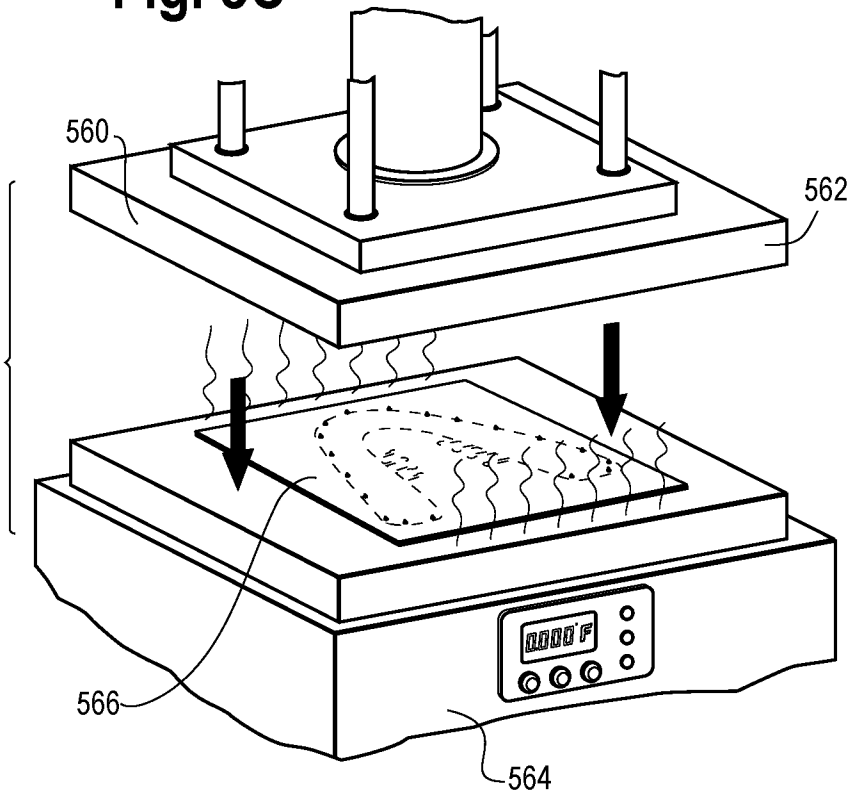

Next, referring to FIG. 5C, the jig 566 may be closed and placed into the heat press 560. The heat press 560 may be preheated to between about 100° C. and about 150° C. (or any other suitable temperature range). The press may then be activated. In one embodiment, the heat press may apply approximately 8 kg/cm^2 of pressure at between about 120° C. and about 150° C. for a period of 30 seconds. When subjected to this heat and pressure, the thermoplastic polymer material of the upper 520, such as the thermoplastic polymer material included with a yarn (i.e., the first yarn 144 described above), may at least partially melt. As a result, the material originally forming separate yarns of the upper 520 may become bonded and/or continuous to form a fused area. Therefore, any one or more areas where the upper 520 contains thermoplastic polymer material, and where that material is subjected to a suitable process (such as the heat-pressing process described herein), it is contemplated that a fused area 126 will be formed. A thermocouple (not shown) may measure the temperature of the upper 520 during this process. Once the upper 520 reaches a predetermined temperature (e.g., between about 120° C. and about 132° C.), the heat press 560 may open, and the upper 520 may be removed. While a heat-pressing process is described, any other suitable process may be used to form the fused areas.

Next, the heated upper 520 may go through a cooling process, such as a cold-pressing process. The cooling process may set the fused area of the upper 520 or otherwise bring the fused area into a state other than a melted state. Referring to FIG. 5D, the upper 520 may be placed in a cold press 580. A silicon pad 582 (which may be any other suitable material) may be placed on one or both sides of the upper 520, and particularly over the heated and/or partially melted areas, to ensure even pressure. The cold press 580 may include a refrigeration system, but in some embodiments the cold press 580 is at or about at room temperature. When activated, in one non-limiting example, the cold press 580 may apply approximately 15-18 kg/cm^2 of pressure for about 12 seconds. During the cold-pressing process, the release paper 570 may remain attached to the upper 520 to prevent the upper 520 from sticking to the cold press 580, though this is not required. Further, while shown without the use of a jig, the cold press 580 can be used in conjunction with a jig similar to the jig 566 described with respect to the heat-pressing process.

Figure 6A:
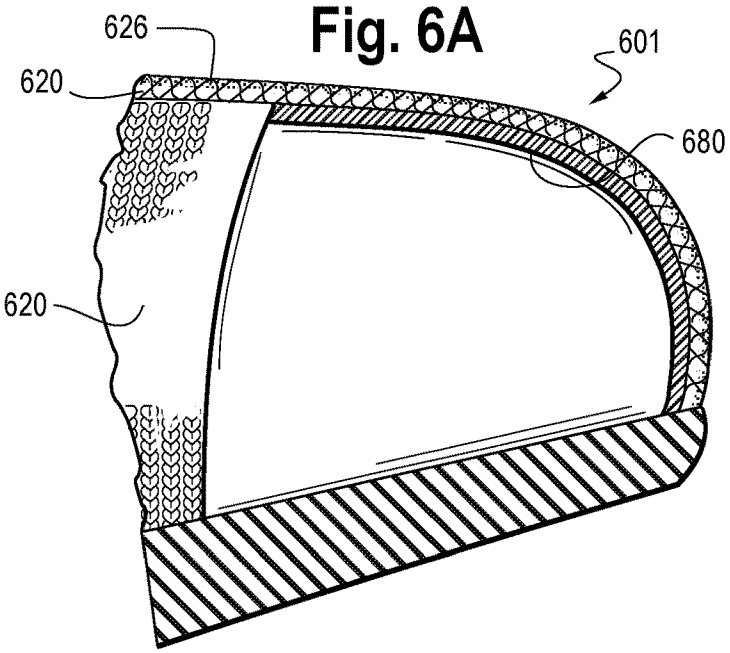
FIG. 6A shows a cutout view of the article of footwear of FIG. 6 having an interior auxiliary component in accordance with certain aspects of this disclosure.

In some embodiments, a heat pressing process may be used to attach an auxiliary component to the upper 520. While not shown, the auxiliary component, which may include a thermoplastic polymer material, may be placed in contact with the upper 520 such that it at least partially melts and thereby adheres to the upper 520 during the heat-pressing process. Alternatively, or in addition, an auxiliary component may be substantially free of a thermoplastic polymer and may be bonded to the upper 520 by placing the auxiliary component in contact with the heated thermoplastic polymer of the upper 520. This may be done in conjunction with the process of forming the fused areas 126 (see FIG. 2) or may be done at a different time. In one exemplary embodiment of an article of footwear, an auxiliary component 680 shown in FIG. 6A may be adhered to the upper 620 during a heat-pressing step. This auxiliary component may provide additional support in the toe area 601 of the article of footwear, for example.

Figure 6:
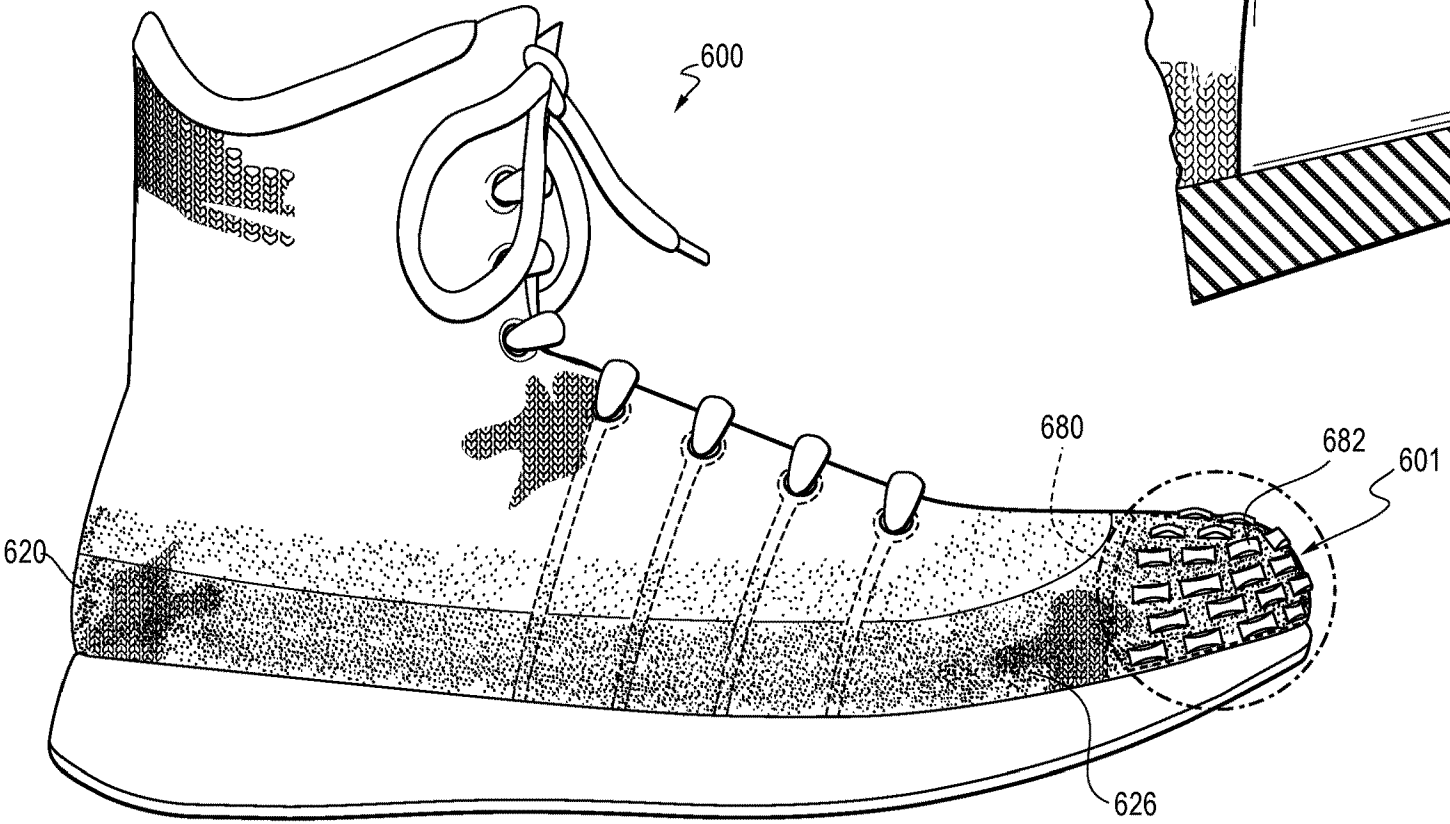
FIG. 6 shows an article of footwear having different types of auxiliary components in accordance with certain aspects of this disclosure.

Auxiliary components may additionally or alternatively be attached to the upper 620 by another suitable process. For example, auxiliary components may be attached with an adhesive, by sewing, by heat-processing, etc. In one example, a high-frequency welding process ("HF welding process") may be used. Referring to the article of footwear 600 shown in FIG. 6, the plurality of second auxiliary components 682 may be attached to the upper using HF welding. The second auxiliary components 682 may, like the fused area 626, be at least partially formed of a thermoplastic polymer material that at least partially melts when heated to a certain temperature. During the HF welding process, energy in the form of electromagnetic energy may be provided (for example, by an electrode, not shown) to the second auxiliary components 682 and/or the fused area 626 which may thereby cause the molecules within the materials of the second auxiliary components 682 and/or the fused area 626 to move at a high-frequency to generate heat. In one non-limiting example, the electromagnetic energy is supplied at about 27.17 MHz. Any suitable amount of electromagnetic energy may be provided. For example, about 0.35 amperes to about 0.45 amperes may be provided for a period of approximately 10 seconds, though any suitable combination of current and time may be used. The generated heat may be sufficient to at least partially melt the second auxiliary components 682 and/or the fused area 626. While not necessary, additional thermal energy (i.e., heat) may be provided in another form during the HF welding process. Once cooled, the second auxiliary components 682 may be secured to the fused area 626. It is contemplated that the second auxiliary components 682 do not necessarily need to be HF welded to the fused area 626, but may rather be HF welded or otherwise secured by mechanical or chemical means to another area of the upper 620.

After the HF welding process (or other process), the upper 620 may go through a cooling process, such as the cold-pressing process described above. Other cooling processes may be used. Further, when an HF welding process is used, the HF welding process may be performed before, during, or after a heat-pressing process.

Auxiliary components may have several advantageous characteristics. For example, the auxiliary component 680 may provide additional support in the toe area 601 of the article of footwear. The second auxiliary components 682 may, in one example, provide a texture that is advantageous for gripping another object. An auxiliary component may be any suitable shape, size, and material, may be secured to the article of footwear using any suitable securement process, and may be configured for any function. In some embodiments, auxiliary components may be primarily for aesthetic purposes, including but not limited to design components, labels, tags and/or logos.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. An upper for an article of footwear, the upper comprising:

a knitted component having a first yarn and a second yarn, wherein the first yarn comprises a core with a sheath, the sheath being formed of a thermoplastic material having a melting temperature, wherein the second yarn is substantially free of the thermoplastic material, wherein the knitted component further comprises a first layer having a first surface and a second layer having a second surface, wherein the first layer and the second layer are secured via a knit structure of the knitted component, wherein the knitted component further comprises a first region located adjacent to a biteline of the upper and a second region located in a throat area of the upper, wherein the first region comprises the first surface substantially formed by the first yarn and the second surface substantially formed by the second yarn, and wherein at least the first surface substantially excludes the first yarn in the second region.

2. The upper of claim 1, wherein the core has a second melting temperature that is higher than the melting temperature of the thermoplastic material.

3. The upper of claim 2, wherein the first yarn of the first surface is incorporated into the second surface at least at one location within the first region.

4. The upper of claim 2, wherein the first region extends along an edge adjacent to the biteline of the upper.

5. The upper of claim 1, wherein the second region comprises the first surface substantially formed by the second yarn and the second surface substantially formed by the first yarn.

6. The upper of claim 5, wherein the second region extends along the throat area of the upper.

7. The upper of claim 1, wherein the first yarn is thermoformed to form a fused area.

8. The upper of claim 1, wherein the thermoplastic material of the sheath consists essentially of at least one thermoplastic polyurethane.

9. The upper of claim 8, where the core of the first yarn comprises at least one polyester.

10. The upper of claim 1, wherein the first layer is integrally knit with the second layer.

11. The upper of claim 1, wherein a fused area formed by the thermoplastic material extends from an edge of the upper towards the throat area, and wherein the fused area terminates adjacent to the throat area.

12. The upper of claim 1, wherein the first yarn is thermoformed to form a fused area, the upper further comprising an auxiliary component formed by a material other than a knitted material and secured to the fused area via the thermoplastic material.

13. An upper for an article of footwear, the upper comprising:

a knitted component having a first yarn and a second yarn, wherein the first yarn comprises a core with a sheath, the sheath being formed of a thermoplastic material having a melting temperature, wherein the second yarn is substantially free of the thermoplastic material, wherein the knitted component further comprises a first layer having a first surface and a second layer having a second surface, wherein the first layer and the second layer are secured via a knit structure of the knitted component, wherein a first fused area is formed by the thermoplastic material on the first layer in a first region, and wherein a second fused area is formed by the thermoplastic material on the first layer in a second region, the second fused area being a transition area including a reduced amount of the thermoplastic polymer material relative to the first fused area.

14. The upper of claim 13, wherein the second yarn forms at least a portion of the first layer in the second region.

15. The upper of claim 14, wherein the first yarn forms at least a portion of the second layer in the second region.

16. The upper of claim 13, wherein the first fused area extends along an edge adjacent to a biteline of the upper, and wherein the second fused area is located between a throat area of the upper and the first fused area.

17. The upper of claim 16, wherein the second fused area terminates adjacent the throat area of the upper.

18. An upper for an article of footwear, comprising:

a knitted component having a first region located adjacent to a biteline, wherein the first region of the knitted component includes an inner surface and an outer surface, wherein the outer surface includes a fused area formed with a thermoformed thermoplastic material included with a first yarn that is interlooped with a second yarn, wherein the inner surface is at least partially formed with the second yarn and substantially excludes the thermoformed thermoplastic material, and wherein a throat area substantially excludes the thermoformed thermoplastic material.

19. The upper of claim 18, wherein the second yarn is free of the thermoplastic material.

20. The upper of claim 18, further comprising an auxiliary component that is coupled to the knitted component via the thermoplastic material included with the first yarn.

* * * * *